US006300291B1

(12) United States Patent
Hartley et al.

(10) Patent No.: US 6,300,291 B1
(45) **Date of Patent: *Oct. 9, 2001**

(54) LUBRICATING OIL COMPOSITION

(75) Inventors: Rolfe J. Hartley, Cranbury; Malcolm Waddoups, Westfield, both of NJ (US); Ian A. W. Bell, Southmoor (GB); Thomas R. Bidwell, Delaware, OH (US); Gordon R. Farnsworth, Scotch Plains, NJ (US); Taisuke Miyoshi, Yokohama (JP)

(73) Assignee: Infineum USA L.P., Linden, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/314,510

(22) Filed: May 19, 1999

(51) Int. Cl.[7] ..... C10M 133/00; C10M 135/18; C10M 137/10; C10I 139/00

(52) U.S. Cl. ..... 508/363; 508/364; 508/365; 508/371; 508/391; 508/545

(58) Field of Search ..... 508/363, 371, 508/364, 365, 391, 545

(56) References Cited

U.S. PATENT DOCUMENTS

| | | | | |
|---|---|---|---|---|
| 4,164,473 | | 8/1979 | Coupland et al. . | |
| 4,176,073 | | 11/1979 | Ryer et al. . | |
| 4,176,074 | | 11/1979 | Coupland et al. . | |
| 4,178,258 | | 12/1979 | Papay et al. . | |
| 4,192,757 | | 3/1980 | Brewster . | |
| 4,201,683 | | 5/1980 | Brewster . | |
| 4,239,633 | | 12/1980 | Gutierrez et al. . | |
| 4,248,720 | | 2/1981 | Coupland et al. . | |
| 4,289,635 | | 9/1981 | Schroeck . | |
| 4,382,006 | * | 5/1983 | Horodysky | 508/545 |
| 4,392,966 | | 7/1983 | Schlicht . | |
| 4,428,848 | | 1/1984 | Levine et al. . | |
| 4,479,883 | | 10/1984 | Shaub et al. . | |
| 4,559,152 | | 12/1985 | Schlicht . | |
| 4,692,256 | | 9/1987 | Umemura et al. . | |
| 4,705,641 | | 11/1987 | Goldblatt et al. . | |
| 4,978,464 | | 12/1990 | Coyle et al. . | |
| 4,990,271 | | 2/1991 | Francis . | |
| 4,992,186 | | 2/1991 | Habeeb et al. . | |
| 5,055,211 | | 10/1991 | Habeeb et al. . | |
| 5,102,566 | | 4/1992 | Fetterman, Jr. et al. . | |
| 5,143,633 | | 9/1992 | Gallo et al. . | |
| 5,356,547 | | 10/1994 | Arai et al. | 508/363 |
| 5,629,272 | | 5/1997 | Nakazato et al. | 508/185 |
| 5,631,212 | | 5/1997 | Vrahopoulou . | |
| 5,650,381 | | 7/1997 | Gatto et al. . | |
| 5,658,862 | | 8/1997 | Vrahopoulou . | |
| 5,719,109 | | 2/1998 | Tokashiki et al. . | |
| 5,744,430 | | 4/1998 | Inoue et al. | 508/295 |
| 5,814,587 | | 9/1998 | Vrahopoulou et al. . | |
| 5,888,945 | * | 3/1999 | Stiefel et al. | 508/363 |

FOREIGN PATENT DOCUMENTS

| | | | |
|---|---|---|---|
| 0 519 760 A1 | 12/1992 | (EP) | C10M/141/10 |
| 609 623 A1 | 8/1994 | (EP) . | |
| 699 739 A2 | 3/1996 | (EP) . | |
| 0 719 851 A2 | 7/1996 | (EP) | C10M/135/18 |
| 0 811 674 A1 | 12/1997 | (EP) | C10M/169/04 |
| WO96/37581 | 11/1996 | (WO) | C10M/133/16 |
| WO98/26030 | 6/1998 | (WO) | C10M/159/18 |

* cited by examiner

*Primary Examiner*—Margaret Medley
*Assistant Examiner*—Cephia D. Toomer

(57) ABSTRACT

A lubricating oil composition exhibiting improved low temperature anti-wear performance and improved fuel economy and fuel economy retention properties, which comprises: (a) an oil of lubricating viscosity; (b) at least one calcium detergent; (c) at least one oil soluble molybdenum compound; (d) at least one nitrogen containing friction modifier; and (e) at least one zinc dihydrocarbyldithiophosphate compound, wherein the composition has a NOACK volatility of about 15.5 wt. % or less and contains from about 0.058 to 0.58 wt. % calcium from the calcium detergent, molybdenum in an amount up to about 350 ppm from a molybdenum compound, and phosphorus in an amount up to about 0.1 wt. % from a zinc dihydrocarbyldithiophosphate compound.

18 Claims, No Drawings

LUBRICATING OIL COMPOSITION

The present invention relates to lubricating oil compositions. More particularly, the present invention relates to lubricating oil compositions, which exhibit improvements in low temperature valve train wear performance, fuel economy and fuel economy retention properties.

BACKGROUND OF THE INVENTION

Additives have been used by many companies to try to improve engine performance. An additive or additive package may be used for a variety of purposes, such as detergency, reducing engine wear, stability against heat and oxidation, reducing oil consumption, corrosion inhibition, to act as a dispersant, and to reduce friction loss. Reducing friction loss is of great interest because of its impact on fuel economy performance. As such, friction modifiers have been given much attention.

It has been proposed in many patents and articles (for example, U.S. Pat. Nos. 4,164,473; 4,176,073; 4,176,074; 4,192,757; 4,248,720; 4,201,683; 4,289,635; and 4,479,883) that oil soluble molybdenum is useful as a lubricant additive. In particular, molybdenum provides enhanced fuel economy in gasoline or diesel fueled engines, including both short and long term fuel economy (i.e., fuel economy retention properties). The prior proposals typically use molybdenum at levels greater than 350 ppm up to 2,000 ppm in additive packages, which contain one or more detergents, anti-wear agents, dispersants, friction modifiers, and the like.

Durability of engine lubricants is becoming an important issue. Today's lubricating oils quickly lose their ability to provide beneficial enhancements to engine performance. This makes it necessary to frequently change the engine's oil. As such oil consumption and maintenance costs increase, leaving car owners with an undesirable burden.

To address this problem, the present inventors have developed a lubricating oil composition that provides initial engine performance benefits and retention of those benefits for a longer period of time than with oils currently available in the marketplace. The composition is less volatile, which enables a greater percentage of the lubricating oil composition to remain in the engine over time. This leads to an improvement in fuel economy and fuel economy retention. Moreover, less maintenance is required, since drainage intervals are extended.

The present inventors have also found that low temperature valve train wear performance, fuel economy and fuel economy retention properties, can be improved to meet the requirements of the next generation of motor oil certification such as the proposed ILSAC GF-3 standards (International Lubricants Standardization and Approval Committee), using much lower levels of molybdenum than currently required in conventional additive packages.

SUMMARY OF THE INVENTION

The present invention concerns a lubricating oil composition which exhibits improved low temperature anti-wear performance and improved fuel economy and fuel economy retention properties, the composition comprising: (a) an oil of lubricating viscosity having a viscosity index of at least 95; (b) at least one calcium detergent; (c) at least one oil soluble molybdenum compound; (d) at least one nitrogen containing friction modifier, and (e) at least one zinc dihydrocarbyldithiophosphate compound. The composition has a NOACK volatility of about 15.5 wt. % or less, and contains from about 0.058 to 0.58 wt. % calcium from the calcium detergent, molybdenum in an amount up to about 350 ppm from a molybdenum compound, and phosphorus in an amount up to about 0.1 wt. % from the zinc dihydrocarbyldithiophosphate. The composition may be prepared by the admixture of the ingredients and such compositions are a further embodiment of this invention.

In addition, the present invention encompasses methods for improving the fuel economy and fuel economy retention properties of an engine and improving the anti-wear properties of an engine, the method comprising the steps of adding the lubricating oil composition of this invention to an engine and operating the engine.

DESCRIPTION OF THE PREFERRED EMBODIMENTS

The lubricating oil compositions of this invention require; (a) an oil of lubricating viscosity having a viscosity index of at least 95; (b) at least one calcium detergent; (c) at least one oil soluble molybdenum-containing compound; (d) at least one nitrogen containing friction modifier; and (e) at least one zinc dihydrocarbyldithiophosphate compound.

Oil of Lubricating Viscosity

The oil of lubricating viscosity may be selected from a wide variety of base stocks including natural oils, synthetic oils, or mixtures thereof. Examples of suitable base stocks may be found in one or more of the base stock groups, or mixtures of said base stock groups, set forth in the American Petroleum Institute (API) publication "Engine Oil Licensing and Certification System," Industry Services Department, Fourteenth Edition, December 1996, Addendum 1, December 1998.

a) Group I base stocks contain less than 90 percent saturates and/or greater than 0.03 percent sulfur and have a viscosity index greater than or equal to 80 and less than 120 using the test methods specified in Table A below.
b) Group II base stocks contain greater than or equal to 90 percent saturates and less than or equal to 0.03 percent sulfur and have a viscosity index greater than or equal to 80 and less than 120 using the test methods specified in Table A below.
c) Group III base stocks contain greater than or equal to 90 percent saturates and less than or equal to 0.03 percent sulfur and have a viscosity index greater than or equal to 120 using the test methods specified in Table A below.
d) Group IV base stocks are polyalphaolefins (PAO).
e) Group V base stocks include all other base stocks not included in Groups I, II, III, or IV.

TABLE A

Analytical Methods for Testing Base Stocks

| Property | Test Method |
|---|---|
| Saturates | ASTM D2007 |
| Viscosity Index | ASTM D2270 |
| Sulfur | ASTM D2622, D4292, D4927, or D3120 |

The oil of lubricating viscosity used in this invention should have a viscosity index of at least 95, preferably at least 100. Preferred oils are (a) base oil blends of Group III base stocks with Group I or Group II base stocks, where the combination has a viscosity index of at least 110; or (b) Group III base stocks or blends of more than one Group III base stock.

Calcium Detergent

The present invention requires the presence of at least one calcium detergent. Detergents aid in reducing deposits that build up in an engine and act as an acid neutralizer or rust inhibitor. This in turn reduces engine wear and corrosion.

The calcium detergent used in this invention may be neutral or overbased and may be derived from phenates, salicylates, sulfonates, or mixtures thereof, with calcium sulfonates being particularly preferred. Preferably, the detergent will be overbased, that is the Total Base Number (TBN) will be at least 1 00 but usually between 100 and 500, more preferably between 150 and 450, and most preferably between 200 and 400. The most preferred detergent for use in this invention is an overbased calcium sulfonate having a TBN between 200 and 400.

The process of overbasing a metal detergent means that a stoichiometric excess of the metal is present over what is required to neutralize the anion of the salt. It is the excess metal from overbasing that has the effect of neutralizing acids which may build up.

In the present invention, overbased calcium sulfonate detergents may be derived from the salt of an oil soluble sulfonic acid, where a mixture of an oil soluble sulfonate or alkaryl sulfonic acid is combined with calcium and heated to neutralize the sulfonic acid that is present. This forms a dispersed carbonate complex by reacting the excess calcium with carbon dioxide. The sulfonic acids typically are obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene, and chloronaphthalene. The alkylation may be carried out in the presence of a catalyst with alkylating agents having from 3 to more than 30 carbon atoms. For example, haloparaffins, olefins obtained by dehydrogenation of paraffins, or polyolefins produced from ethylene or propylene are all suitable. The alkaryl sulfonates usually contain from about 9 to about 70 or more carbon atoms, preferably from about 16 to about 50 carbon atoms per alkyl substituted aromatic moiety.

The oil soluble sulfonates are neutralized with a calcium compound. The amount of calcium that is used to neutralize the oil soluble sulfonate is carefully chosen with regard to the desired total base number (TBN) of the final product.

In the present invention, the amount of calcium detergents used can vary broadly, but typically will be from about 0.5% to about 5% wt. %, based on the total weight of the composition. This corresponds to about 0.058 to 0.58 wt. % calcium from the calcium detergent in the finished composition. Preferably the composition will contain between about 0.112 to 0.42 wt. % of calcium from the calcium detergent.

Calcium phenates and calcium salicylates may be prepared using a variety of methods well known in the art.

Molybdenum Compound

For the lubricating oil compositions of this invention, any suitable oil soluble organo-molybdenum compound may be employed. Preferably, dimeric and trimeric molybdenum compounds are used. Examples of such oil soluble organo-molybdenum compounds are the dialkyldithiocarbamates, dialkyldithiophosphates, dialkyldithiophosphinates, xanthates, thioxanthates, carboxylates and the like, and mixtures thereof. Particularly preferred are molybdenum dialkyldithiocarbamates.

The molybdenum dialkyldithiocarbamate dimer to be used as an additive in the present invention is a compound expressed by the following formula:

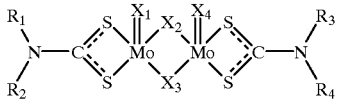

$R_1$ through $R_4$ independently denote a straight chain, branched chain or aromatic hydrocarbyl group; and $X_1$ through $X_4$ independently denote an oxygen atom or a sulfur atom. The four hydrocarbyl groups, $R_1$ through $R_4$, may be identical or different from one another.

An other group of organo-molybdenum compounds useful in the lubricating compositions of this invention are trinuclear (trimeric) molybdenum compounds, especially those of the formula $Mo_3S_kL_nQ_z$ and mixtures thereof wherein the L are independently selected ligands having organo groups with a sufficient number of carbon atoms to render the compound soluble in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are selected from the group consisting of

1

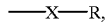

2

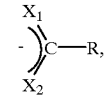

3

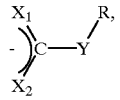

4

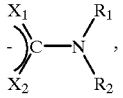

5

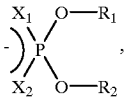

and mixtures thereof wherein X, $X_1$, $X_2$, and Y are selected from the group consisting of oxygen and sulfur, and wherein $R_1$, $R_2$, and R are selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predonnantly hydrocarbyl in character. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

Importantly, the organo groups of the ligands have a sufficient number of carbon atoms to render the compound soluble in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, carboxylates, dialkyldithiocarbamate, and mores thereof. Most preferred are the dialkyldithiocarbamates. Those skilled in the art will realize that formation of the compounds of the present invention requires selection of ligands having the appropriate charge to balance the core's charge (as discussed below).

Compounds having the formula $Mo_3S_kL_nQ_z$ have cationic cores surrounded by anionic ligands, wherein the cationic cores are represented by structures such as

6

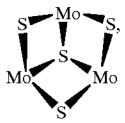

and

7

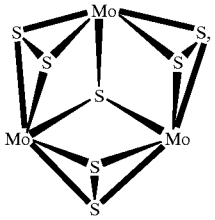

which have net charges of ±4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate, i.e., having multiple connections to one or more cores. It is believed that oxygen and/or selenium may be substituted for sulfur in the core(s).

Oil-soluble trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble trinuclear molybdenum compounds can be formed during a reaction in the appropriate solvent(s) of a molybdenum source such as $(NH_4)_2Mo_3S_{13}.n(H_2O)$, a ligand source such as tetralylthiuram disulfide, dialkyldithiocarbamate, or dialkyldithiophosphate, and a sulfur abstracting agent such as cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble trinuclear molybdenum compound. The appropriate liquid/solvent may be, for example, aqueous or organic.

The ligand chosen must have a sufficient number of carbon atoms to render the compound soluble in the lubricating composition. The term "oil-soluble" as used herein does not necessarily indicate that the compounds or additives are soluble in the oil in all proportions. It does mean, that they are soluble in use, transportation, and storage.

A sulfurized molybdenum containing composition prepared by (i) reacting an acidic molybdenum compound and a basic nitrogen compound selected from the group consisting of succinimide, a carboxylic acid amide, a hydrocarbyl monoamine, a phosphoramide, a thiophosphoramide, a Mannich base, a dispersant viscosity index improver, or a mixture thereof in the presence of a polar promoter, to form a molybdenum complex (ii) reacting the molybdenum complex with a sulfur containing compound, to thereby form a sulfur and molybdenum containing composition is useful within the context of this invention. The sulfurized molybdenum containing compositions may be generally characterized as a molybdenum/sulfur complex of a basic nitrogen compound. The precise molecular formula of these molybdenum compositions is not known with certainty. However, they are believed to be compounds in which molybdenum, whose valences are satisfied with atoms of oxygen or sulfur, is either complexed by, or the salt of one or more nitrogen atoms of the basic nitrogen atoms of the basic nitrogen containing compound used in the preparation of these compositions.

The lubricating compositions of the present invention must contain a minor amount of an oil soluble molybdenum compound. An amount up to about 350 ppm of molybdenum from a molybdenum compound must be present in the lubricating oil composition. Preferably, about 10 ppm to 350 ppm of molybdenum from a molybdenum compound is used. More preferably, the molybdenum is present in an amount of about 30 ppm to 200 ppm, and most preferably in an amount of about 50 ppm to 100 ppm. These values are based upon the weight of the lubricating composition.

Nitrogen Containing Friction Modifiers

At least one nitrogen containing oil soluble friction modifier must be incorporated in the lubricating oil composition. Typically, the nitrogen containing friction modifier makes up about 0.02 to 2.0 wt. % of the lubricating oil composition. Preferably, from 0.05 to 1.0, more preferably from 0.1 to 0.5, wt. % of the friction modifier is used. Examples of such nitrogen containing friction modifiers include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, and the like.

Such friction modifiers can contain hydrocarbyl groups that can be selected from straight chain branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Preferred hydrocarbyl groups range from 12 to 25 carbon atoms and may be saturated or unsaturated. More preferred are those with linear hydrocarbyl groups.

Preferred friction modifiers include amides of polyamines. Such compounds can have hydrocarbyl groups that are linear, either saturated or unsaturated or a mixture thereof and contain 12 to 25 carbon atoms.

Particularly preferred friction modifiers are alkoxylated amines and alkoxylated ether amines, with alkoxylated amines containing about two moles of alkylene oxide per mole of nitrogen being the most preferred. Such compounds can have hydrocarbyl groups that are linear, either saturated, unsaturated or a mixture thereof. They contain 12 to 25 carbon atoms and may contain one or more hetero atoms in the hydrocarbyl chain. Ethoxylated amines and ethoxylated ether amines are especially preferred.

The amines and amides may be used as such or in the form of an adduct or reaction product with a boron compound such as a boric oxide, boron halide, metaborate, boric acid or a mono-, di- or tri-alkyl borate.

Zinc Dihydrocarbyldithiophosphate Compound

At least one zinc dihydrocarbyldithiophosphate must be added to the lubricating oil composition. Preferably zinc dialkylthiophosphate is used. This provides antioxidant and anti-wear properties to the lubricating composition. They may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbonol (4-methyl-1-pentane-2-ol), 1-pentanol, 2-methyl butanol, and 2-methyl-1-propanol. The at least one zinc dihydrocarbyldithiophosphate compound can be a primary zinc, secondary zinc, or mixtures thereof. That is, the zinc compound contains primary and/or secondary alkyl groups. The alkyl groups can have 1 to 25 carbons, preferably 3 to 12 carbons. Moreover, there is preferably, at least about 50 mole % primary zinc from a dihydrocarbyldithiophosphate compound in the at least one zinc dihydrocarbyldithiophosphate compound.

In addition, the lubricating oil composition must have a low phosphorus content, that is the phosphorus from the zinc dihydrocarbyldithiophosphate compound should be present in an amount up to about 0.1 wt. %. Preferably, the phosphorus content from the zinc dihydrocarbyldithiophosphate should be from about 0.025 wt. % to about 0.1 wt. %.

It is also necessary that the volatility of the lubricating oil composition, as measured using the NOACK Volatility Test, be about 15.5 wt. % or less, such as in the range of 4 to 15.5 wt. %, preferably in the range of 8 to 15 wt. %. The NOACK Volatility Test is used to measure the evaporative loss of an oil after 1 hour at 250° C. according to the procedure of ASTM D5800. The evaporative loss is reported in mass percent.

The compositions can be used in the formulation of crankcase lubricating oils (i.e., passenger car motor oils, heavy duty diesel motor oils, and passenger car diesel oils) for spark-ignited and compression-ignited engines. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–10 |
| Other Metal detergents | 0.1–15 | 0.2–9 |
| Corrosion inhibitor | 0–5 | 0–1.5 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Other Friction Modifiers | 0–5 | 0–1.5 |
| Viscosity Modifier | 0.01–20 | 0–15 |
| Synthetic and/or Mineral Base Stock | Balance | Balance |

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

Other metal-containing or ash-forming detergents, besides the calcium detergent, may be present and function both as detergents to reduce or remove deposits and as acid neutralizers or runs inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as maybe measured by ASTM D-2896 of from 0 to 80. It is possible to include large amounts of a metal base by reacting an excess of a metal compound such as an oxide or hydroxide with an acid gas such a such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Such other known detergents include oil-soluble neutral and overbased, sulfonates, sulfurized phenates, thiophosphonates, and naphthenates and other oil-soluble carboxylates of a metal, particularly the alkali or alkaline earth metals, e.g., sodium, potassium, lithium, and magnesium.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236;

3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl substituted diphenylamine, alkyl substituted phenyl and napthylamines, phosphorus esters, metal thiocarbamates, ashless thiocarbamates and oil soluble copper compounds as described in U.S. Pat. No. 4,867,890. Most preferred are the alkyl substituted diphenylamines.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

A small amount of a demulsifying component may be used. A particularly suitable demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Some of the above-mentioned additives can provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate of the present invention is used for blending with an oil of lubricating viscosity, the concentrate comprising: (a) at least one calcium detergent; (b) at least one oil soluble molybdenum compound; (c) at least one nitrogen containing friction modifier; and (d) at least one zinc dihydrocarbyldithiophosphate compound, to provide a lubricating oil composition having a NOACK volatility of about 15.5 wt. % or less, from about 0.058 to 0.58 wt. % calcium from a calcium detergent, molybdenum in an amount up to about 350 ppm from a molybdenum compound, and phosphorus in an amount up to about 0.1 wt. % from a zinc dihyrdcarbyldithiophosphate compound.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formation may employ from 2 to 20 mass %, preferably 4 to 18 mass %, and most preferably about 5 to 17 mass % of the concentrate or additive package, with the remainder being base stock.

This invention also contemplates a method for improving the fuel economy and fuel economy retention properties of an internal combustion engine which comprises the step of adding to the engine the lubricating oil composition of the present invention and operating the engine.

Furthermore, the present invention includes a method for improving the anti-wear protection of an internal combustion engine, comprising the steps of: (1) adding a lubricating oil composition which exhibits improved fuel economy and fuel economy retention properties to an engine, the composition comprising: (a) an oil of lubricating viscosity; (b) at least one calcium detergent; (c) at least one oil soluble molybdenum compound; (d) at least one nitrogen containing friction modifier; and (d) at least one zinc dihydrocarbyldithiophosphate compound, wherein the composition has a NOACK volatility of about 15.5 wt. % or less, from about 0.058 to 0.58 wt. % calcium from the calcium detergent, molybdenum in an amount up to about 350 ppm from a molybdenum compound, and phosphorus in an amount up to about 0.1 wt. % from the zinc dihydrocarbyldithiophosphate compound, and (2) operating the engine thereby obtaining an average cam lobe wear of less than 100 microns as measured by the ASTM Sequence IVA Test.

EXAMPLE 1

TABLE 1

ASTM Sequence VIB Test Results

| Oils Tested | Oil 1 | Oil 2 |
|---|---|---|
| Base Oil | Group I/III blend | Group I/III blend |
| Viscosity @ 100° C., cSt | 4.6 | 4.6 |
| Viscosity Index | 126 | 126 |
| Detergent | | |
| Wt. % Ca from a 300 TBN | 0.174 | .045 |

TABLE 1-continued

ASTM Sequence VIB Test Results

| Oils Tested | Oil 1 | Oil 2 |
|---|---|---|
| Sulfonate | | |
| Wt. % Ca from a 168 TBN Salicylate | — | .147 |
| Friction Modifier, Wt. % | | |
| Ethoxylated amine | 0.2 | — |
| Dimeric MoDTC | — | 780 ppm |
| Trimeric MoDTC | 100 ppm | |
| Phosphorus, Wt. % | 0.091 | 0.092 (calc.) |
| Zinc dithiophosphate, Wt. % | | |
| 85/15 secondary/primary | 0.58 | — |
| All primary | 0.58 | 0.26 |
| All secondary | — | 0.93 |
| Sulfur compound, Wt. % | — | 0.97 |
| NOACK, Wt. % | 14.9 | 14.9 |
| SAE viscosity grade | 5W-30 | 5W-30 |
| ATSM Sequence VIB fuel economy improvement, % | | |
| Phase I | 1.67 | 1.49 |
| Phase II (retained) | 1.73 | 0.91 |

The ASTM Sequence VIB test measures fuel economy improvement versus a baseline calibration oil after 16 hours of aging (Phase I) and fuel economy improvement after 96 hours of aging (Phase II or retained fuel economy). The test is designed to simulate field performance of a lubricant.

The compositions of this invention (Oil 1) and comparative example (Oil 2) are shown in Table 1 along with the corresponding Sequence VIB data.

Oil 1 and Oil 2 have identical base oil compositions. The difference between the two formulations is the additive package that is used. Oil 1 is formulated using a trimeric molybdenum dithiocarbamate, while Oil 2 is formulated with a high level of dimeric molybdenum dithiocarbamate. These types of formulations are designed to offer high levels of fuel economy improvement. A supplemental sulfur source is added to Oil 2 to enhance durability of fuel economy. Oil 2 is not part of the invention claimed because of the high level of molybdenum in the lubricant.

The ASTM Sequence VIB fuel economy results show that Oil 1 performs better than Oil 2 in Phase I and is much better than Oil 2 in Phase II where retained fuel economy data is compared.

TABLE 2

ASTM Sequence IVA Test Results

| Oils | Oil 1 | Oil 2 | Oil 3 | Oil 4 |
|---|---|---|---|---|
| Wt. % Ca from 300 TBN Ca sulfonate | 0.139 | 0.139 | 0.139 | 0.139 |
| Friction modifier type | Ethoxylated amine | Ethoxylated amine | Polyamine amide | Polyamine amide |
| Friction modifier amount, Wt. % | 0.2 | 0.2 | 0.2 | 0.2 |
| Mo, ppm Trimeric MoDTC | 0 | 200 | 0 | 200 |
| Phosphorus, Wt. % | 0.0866 | 0.0902 | 0.0909 | 0.0902 |

TABLE 2-continued

ASTM Sequence IVA Test Results

| Oils | Oil 1 | Oil 2 | Oil 3 | Oil 4 |
|---|---|---|---|---|
| Zinc dithiophosphate, Wt. % | | | | |
| All primary | 0.29 | 0.87 | 0.29 | 0.87 |
| All secondary | 0.87 | 0.29 | 0.87 | 0.29 |
| Viscosity Grade | 5W-30 | 5W-30 | 5W-30 | 5W-30 |
| Base oil type (Group II) | 4.4 cSt at 100° C., Viscosity Index of 115 | 4.4 cSt at 100° C., Viscosity Index of 115 | 4.4 cSt at 100° C., Viscosity Index of 115 | 4.4 cSt at 100° C., Viscosity Index of 115 |
| NOACK, Wt. % | 15.3 | 15.3 | 15.5 | 14.8 |
| Sequence IVA Results | | | | |
| Cam Nose Wear, Avg., microns | 9.75 | 3.16 | 13.12 | 2.37 |
| Cam Lobe Wear, Avg., Microns | 68.9 | 20.95 | 70.26 | 18.1 |

Table 2 shows the experimental variables and the results of a statistically designed experiment conducted to investigate the effects of formulation variables on the ASTM Sequence IVA low temperature valve train wear test.

The Sequence IVA test is designed to measure how well a lubricant provides low temperature valve train anti-wear performance. Cam lobe and nose are measured before and after the test and the wear is expressed in terms of microns of wear.

Oils 2 and 4 are the inventive examples and Oils 1 and 3 are the comparative examples. Inspection of the data in Table 2 shows that Oils 2 and 4 are much better in providing anti-wear protection than are Oils 1 and 3. The data demonstrates that a significant improvement in anti-wear performance is provided when trimeric molybdenum dithiocarbamate is added to the formulation at 200 ppm molybdenum.

TABLE 3

ASTM Sequence IVA Test Results

| Oils | Oil 1 | Oil 2 | Oil 3 | Oil 4 |
|---|---|---|---|---|
| Wt. % Ca from 300 TBN Ca sulfonate | 0.139 | 0.139 | 0.139 | 0.139 |
| Ethoxylated amine, Wt. % | 0.2 | 0.2 | 0.2 | 0.2 |
| Trimeric MoDTC, Wt. % | 0.071 | 0 | 0 | 0 |
| Dimeric MoDTC, Wt. % (Molyvan 822) | 0 | 0.408 | 0 | 0 |
| Dimeric MoDTC, Wt. % (Sakuralube 165) | 0 | 0 | 0 | 0.444 |
| Mo, ppm Dimeric MoDTC | 0 | 207 | 0 | 200 |
| Mo, ppm Trimeric MoDTC | 49 | 0.0 | 0 | 0 |
| Phosphorus, Wt. % | 0.0941 | 0.0943 | 0.093 | 0.0978 |
| Zinc Dithiophosphate, Wt. % (all primary) | 1.16 | 1.16 | 1.16 | 1.16 |
| Viscosity Grade | 5W-30 | 5W-30 | 5W-30 | 5W-30 |
| Base oil type (Group II) | 4.4 cSt at 100° C., Viscosity Index of 115 | 4.4 cSt at 100° C., Viscosity Index of 115 | 4.4 cSt at 100° C., Viscosity Index of 115 | 4.4 cSt at 100° C., Viscosity Index of 115 |

TABLE 3-continued

| ASTM Sequence IVA Test Results | | | | |
|---|---|---|---|---|
| Oils | Oil 1 | Oil 2 | Oil 3 | Oil 4 |
| NOACK, Wt. % | 14.3 | 14.4 | 15.2 | 15.5 |
| Sequence IVA Results | | | | |
| Cam Nose Wear, Avg., microns | 4.59 | 2.7 | 24.15 | 2.51 |
| Cam Lobe Wear, Avg., Microns | 29.87 | 21.37 | 161.06 | 17.81 |

Table 3 shows the results of an experiment to test the effect of different types of molybdenum dithiocarbamates on the anti-wear performance of SAE 5W-30 lubricants in the ASTM Sequence IVA low temperature valve train wear test. All formulations are identical except for molybdenum type and amount.

Oils 1, 2, and 4 are inventive examples and Oil 3 is the comparative example. All four oils are formulated with all primary zinc dialkyldithiophosphate. Oil 3 contains no molybdenum and shows significant average cam lobe wear (161.06 microns) relative to the other oils. Oils 2 and 4 contain 207 ppm and 200 ppm, of molybdenum from Molyvan 822 and Sakuralube165, respectively. Both show excellent passing results and demonstrate that dimeric molybdenum dithiocarbamates are suitable for providing excellent anti-wear performance. Oil 1 is formulated with 49 ppm molybdenum from a trimeric molybdenum dithiocarbamate. Oil 1 also shows excellent anti-wear performance compared with the comparative example of Oil 3 (identical oils except for the molybdenum content). This demonstrates that the anti-wear benefit imparted to the lubricant from the trimeric molybdenum dithiocarbamate is obtained at about 50 ppm molybdenum.

While we have shown and described several embodiments in accordance with our invention, it is to be clearly understood that the same are susceptible to numerous changes apparent to one skilled in the art. Therefore, we do not wish to be limited to the details shown and described but intend to show all changes and modifications which come within the scope of the appended claims.

What is claimed is:

1. A lubricating oil composition which exhibits improved low temperature anti-wear performance, improved fuel economy and fuel economy retention properties, said composition comprising:

a) an oil of lubricating viscosity having a viscosity index of at least 95;

b) at least one calcium detergent;

c) at least one oil soluble molybdenum compound;

d) at least one nitrogen containing friction modifier; and e) at least one zinc dihydrocarbyldithiophosphate compound, wherein said composition has a NOACK volatility of about 15.5 wt. % or less, from about 0.058 to 0.58 wt. % calcium from the calcium detergent, molybdenum in an amount up to about 350 ppm from the molybdenum compound, and phosphorus in an amount up to about 0.1 wt. % from the zinc dihydrocarbyldithiophosphate compound.

2. The composition according to claim 1 wherein said calcium detergent is selected from the group consisting of calcium phenates, calcium salicylates, calcium sulfonates, and mixtures thereof.

3. The composition according to claim 1 wherein said calcium detergent is an overbased calcium sulfonate.

4. The composition according to claim 3 wherein said overbased calcium sulfonate has a total base number of between about 150 to 450.

5. The composition according to claim 1 wherein said molybdenum from a molybdenum compound is present in an amount of about 10 ppm to 350 ppm.

6. The composition according to claim 5 wherein said molybdenum from a molybdenum compound is present in an amount of about 30 ppm to 200 ppm.

7. The composition according to claim 1 wherein said molybdenum compound is an organo-molybdenum compound.

8. The composition according to claim 1 wherein said molybdenum compound is selected from the group consisting of: a molybdenum dialkyldithiocarbamate, molybdenum dialkyldithiophosphate, molybdenum dialkyldithiophosphinate, molybdenum xanthate, molybdenum thioxanthate, and mixtures thereof.

9. The composition according to claim 8 wherein said molybdenum compound is present as molybdenum dialkyldithiocarbamate.

10. The composition according to claim 1 wherein said molybdenum compound is a trinuclear molybdenum compound.

11. The composition according to claim 1 wherein said molybdenum compound is a molybdenum/sulfur complex of a basic nitrogen compound.

12. The composition according to claim 1 wherein said at least one zinc dihydrocarbyldithiophosphate compound comprises zinc from a primary alkyl group, secondary alkyl group, or mixtures thereof.

13. The composition according to claim 12 wherein said at least one zinc dihydrocarbyldithiophosphate compound comprises at least about 50 mole % primary zinc from a dihydrocarbyldithiophosphate compound.

14. The composition according to claim 1 wherein said at least one nitrogen containing friction modifier is an ethoxylated amine.

15. The composition according to claim 1 wherein said phosphorus content is about 0.025 wt. % to 0.1 wt. % from the zinc dihydrocarbyldithiophosphate compound.

16. A method for improving the fuel economy and fuel economy retention properties of an internal combustion engine, which comprises: (1) adding to said engine the lubricating oil composition of claim 1; and (2) operating said engine.

17. A method for improving the anti-wear protection of an internal combustion engine comprising the steps of: (1) adding a lubricating oil composition which exhibits improved fuel economy and fuel economy retention properties to an engine, said composition comprising:

(a) an oil of lubricating viscosity;

(b) at least one calcium detergent;

(c) at least one oil soluble molybdenum compound;

(d) at least one nitrogen containing friction modifier; and (e) at least one zinc dihydrocarbyldithiophosphate compound, wherein said composition has a NOACK volatility of about 15.5 wt. % or less, from about 0.058 to 0.58 wt. % calcium from the calcium detergent, molybdenum in an amount up to about 350 ppm from the molybdenum compound, and phosphorus in an amount up to about 0.1 wt. % from the zinc dihydrocarbyldithiophosphate compound; and (2) operating the engine, thereby obtaining an average cam lobe wear of less than 100 microns as measured by the ASTM Sequence IVA Test.

18. A concentrate for blending with an oil of lubricating viscosity, said concentrate comprising:

(a) at least one calcium detergent;

(b) at least one oil soluble molybdenum compound;

(c) at least one nitrogen containing friction modifier; and (d) at least one zinc dihydrocarbyldithiophosphate compound, to provide a lubricating oil composition having a NOACK volatility of about 15.5 wt. % or less, from about 0.058 to 0.58 wt. % calcium from the calcium detergent, molybdenum in an amount up to about 350 ppm from the molybdenum compound, and phosphorus in an amount up to about 0.1 wt. % from the zinc dihydrocarbyldithiophosphate compound.

* * * * *